United States Patent [19]

Shimizu et al.

[11] 4,225,295

[45] Sep. 30, 1980

[54] GAS SEAL MEANS FOR ROTARY PISTON ENGINES

[75] Inventors: Kazuma Shimizu; Shiso Kariyama; Yoshimitsu Takeda; Masato Yoshimura, all of Hiroshima, Japan

[73] Assignee: Toyo Kogyo Co., Ltd., Hiroshima, Japan

[21] Appl. No.: 954,866

[22] Filed: Oct. 26, 1978

[30] Foreign Application Priority Data

Oct. 31, 1977 [JP] Japan ..... 52-131301

[51] Int. Cl.³ ..... F01C 19/08; F01C 21/08

[52] U.S. Cl. ..... 418/142; 418/152; 418/178

[58] Field of Search ..... 418/142, 152, 178; 277/216, DIG. 6; 92/223, 222

[56] References Cited

U.S. PATENT DOCUMENTS

| | | | |
|---|---|---|---|
| Re. 18,814 | 5/1933 | Summers | 92/223 |
| 2,616,615 | 11/1952 | Scott | 418/152 |
| 2,992,869 | 7/1961 | Van Der Horst | 92/223 |
| 3,359,956 | 12/1967 | Bentele | 418/178 |
| 3,612,538 | 10/1971 | Sievenpiper | 277/DIG. 6 |
| 4,028,021 | 6/1977 | Berkowitz | 418/142 |

FOREIGN PATENT DOCUMENTS

| | | | |
|---|---|---|---|
| 992226 | 5/1965 | United Kingdom | 418/152 |

*Primary Examiner*—John J. Vrablik

*Attorney, Agent, or Firm*—Fleit & Jacobson

[57] ABSTRACT

Rotary piston engine has a rotor which is applied with coatings of a fluoride resin at each side surface in the vicinity of side seals so as to fill clearance between the rotor side surface and the adjacent inner surface of the side housing whereby an improved gas-tightness is obtained.

5 Claims, 2 Drawing Figures

GAS SEAL MEANS FOR ROTARY PISTON ENGINES

Figure 1:
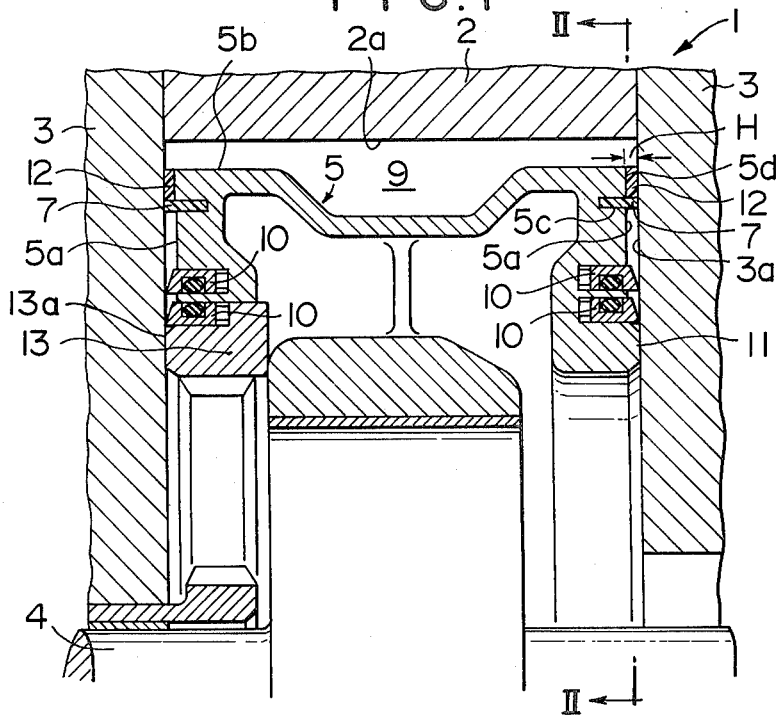

The present invention relates to rotary piston engines and more particularly to gas seal means for rotary piston engines.

Conventional rotary piston engines include a casing comprised of a rotor housing having an inner wall of trochoidal configuration and a pair of side housings secured to the opposite sides of the rotor housing. In the casing, there is disposed a substantially polygonal rotor which is mounted for rotation with apex portions in sliding contact with the inner wall of the rotor housing. In order to provide gas-tight seal between adjacent working chambers, apex seals are mounted on respective ones of the rotor apex portions and slidably engaged with the inner wall of the rotor housing. On the side surfaces of the rotor which are facing to the side housings, there are provided side seals which extend substantially along rotor flanks in circumferential direction and slidably engage the inner surfaces of the side housings. Further, the rotor is provided on each side surface at portions adjacent to the apices with corner seals which are located at junctions between end portions of the apex seals and end portions of the side seals so as to separate working chambers gas-tightly from each other.

In such rotary piston engines, the rotors are also formed with axially projecting lands on the side surfaces thereof at radially inner portions with respect to oil seals which are also provided on the side surfaces. Such lands are adapted for slidable engagement with the inner surfaces of the side housings so that suitable clearances are maintained between the side surfaces of the rotors and the adjacent inner surfaces of the side housings at portions radially outside of the lands for the purpose of preventing the radially outward portions of the rotors from being brought into contact with the side housings at relatively high circumferential speed, possibly causing seizures of the rotors against the side housings. The object of the side seals is to provide gas-tightness at the clearances between the rotor side surfaces and the side housings and they are generally received in seal grooves formed in the rotor side surfaces substantially along the rotor peripheral edges. In order to bias the side seals against the side housings, resilient springs are provided in the seal grooves, however, since the side seals are of arcuated shapes, it is difficult to maintain uniform contacts with the side housings throughout the lengths of the side seals. Thus, when the pressure of combustion gas is transmitted through the clearances between the rotor and the side housings, and applied to the side seals, the sealing contacts between the side seals and the side housings are partially broken and combustion gas is allowed to leak through the side seals.

The present invention has therefore an object to provide effective means for preventing combustion gas leakage through the clearances between the rotor side surfaces and the adjacent side housings.

Another object of the present invention is to provide simple and durable means for increasing the flow resistance along the clearances between the rotor side surfaces and the adjacent side housings.

According to the present invention, the above and other objects can be accomplished by a rotary piston engine including a casing which is comprised of a rotor housing having an inner wall surface of trochoidal configuration and a pair of side housings respectively having inner surfaces and secured to the opposite sides of the rotor housing, a substantially polygonal rotor disposed in said casing for rotation with apex portions in sliding contact with the inner wall surface of the rotor housing, said rotor having opposite side surfaces respectively confronting with the inner surfaces of the side housings with clearances between the rotor side surfaces and the inner surfaces of the side housings, said rotor further having flanks defined between respective two of the apex portions and confronting to the inner wall surface of the rotor housing, side seal means provided on each side surface of the rotor and extending substantially along the flanks of the rotor at portions radially inwardly of the flanks to leave circumferential areas on each of the rotor side surfaces between the flanks and the side seal means, and filler means comprised of a fluoride resin and applied to each of the rotor side surfaces at areas substantially around said side seal means for substantially filling said clearance between the rotor side surfaces and the inner surfaces of the side housings in said areas around the side seal means.

According to the arrangement of the present invention, the filler means serves to eliminate or at least decrease the clearance between the rotor side surfaces and the inner surfaces of the side housings. Thus, the flow resistances through the clearances are increased to substantial extent so that leakage of combustion gas can significantly be decreased.

In a preferable aspect of the present invention, the fluoride resin is deposited substantially throughout the aforementioned circumferential areas on the rotor side surface. In conventional rotary piston engines, it has been recognized that the clearances between the rotor side surfaces and the inner surfaces of the side housings provide additional volumes to the corresponding working chambers and, since such additional volumes are of large surface-to-volume ratios, they have adverse effects of quenching the combustion gas. However, in the aforementioned arrangement wherein the fluoride resin is deposited substantially throughout the circumferential areas on the rotor side surfaces, combustion gas can substantially be excluded from the clearances between the rotor side surfaces and the inner surfaces of the side housings so that it is possible to avoid the aforementioned quenching of the combustion gas.

The primary object of the present invention can however be accomplished even where the fluoride resin is deposited on areas extending radially inwardly of the side seal means. In fact, the fluoride resin may be deposited on either or both sides of the side seal means to provide the filler means.

Since the filler means is adapted to slide along the inner surface of the side housing as the rotor rotates and is subjected to a high temperature applied from the combustion gas, it is recommended as the material for the filler means to use a fluoride resin which has a satisfactory heat-resistant property and is not harmful to the side housing. Such fluoride resin may include tetrafluoroethylene, tetrafluoroethylene-hexafluoropropylene copolymer, tetrafluoroethylene-perfluoroalkoxyethylene copolymer, trifluoroethylene chloride, tetrafluoroethylene-ethylene copolymer, and vinylidene fluoride. The most recommendable resin is tetrafluoroethylene. Such fluoride resin may be used in a powder form and mixed with a thermosetting resin such as polyimide resin. The mixture is then dissolved in a solvent such as normalmethyl-2-pyrrolidone and applied to the rotor. Then, the applied resin is heated to a temperature between 150° and 300° C. to form a coating of resin. The thickness of the coating may be substantially equal to or slightly less than the clearance between the rotor side surface and the inner surface of the side housing, said clearance being usually 100 to 150 mincrons.

In order to provide improved wear-resistance and strength of the fluoride resin coating, the resin may be added with 1 to 5% in weight of solid lubrication agent such as $MoS_2$, carbon or graphite.

Figure 2:
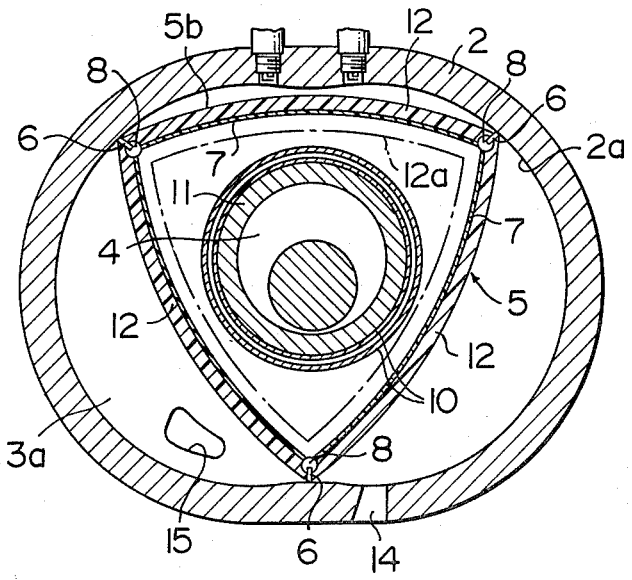

The above and other objects and features of the present invention will become apparent from the following description of a preferred embodiment taking reference to the accompanying drawings, in which;

FIG. 1 is a fragmentary sectional view of a rotary piston engine in accordance with one embodiment of the present invention; and, FIG. 2 is a sectional view taken substantially along the line II—II in FIG. 1.

Referring now to the drawings, the rotary piston engine shown therein includes a casing 1 which comprises a rotor housing 2 having an inner wall surface 2*a* of trochoidal configuration and a pair of side housings 3 having inner surfaces 3*a* and secured to the opposite sides of the rotor housing 2. A substantially triangular rotor 5 is disposed in the casing 1 and mounted on an eccentric shaft 4 for rotation with apex seals 6 on apex portions thereof in slidable contact with the inner wall surface 2*a* of the rotor housing 2. Working chambers 9 of variable volume are therefore defined in the casing by the rotor flanks 5*b*, the inner wall surface 2*a* of the rotor housing 2 and the inner surfaces 3*a* of the side housings 3. The rotor 5 has opposite side surfaces 5*a* which are facing to the inner surfaces 3*a* of the side housings 3 and rotor flanks 5*b* which are facing to the inner wall surface 2*a* of the rotor housing 2.

On each of the side surfaces 5*a*, the rotor is formed with side seal grooves 5*c* in which side seals 7 are received. As shown in FIG. 2, the side seals 7 extend substantially along the rotor flanks 5*b* at positions radially inwardly retarded from the flanks so as to leave circumferential areas 5*d* on the rotor side surfaces 5*a* between the rotor flanks 5*b* and the side seals 7. As well known in the art, a corner seal 8 is provided at each junction between the apex seal 6 and the side seals 7. Further, circular oil seals 10 of conventional design are mounted on each side surface 5*a* of the rotor 5.

At one side, the rotor 5 has an internal gear 13 which has a side surface 13*a* axially projecting beyond the adjacent side surface 5*a*. At the other side, the rotor 5 is formed with an axially projecting land 11. The land 11 and the side surface 13*a* of the internal gear 13 are adapted to contact with the inner surfaces 3*a* of the side housings 3 so as to determine the axial position of the rotor 5. Thus, clearances H are maintained between the rotor side surfaces 5*a* and the inner surfaces 3*a* of the side housings 3. As conventional in the art, the casing 1 is formed with an exhaust port 14 and an intake port 15.

According to the illustrated embodiment of the present invention, the rotor 5 is applied on each side surface 5*a* with fillers or coatings 12 of a fluoride resin at the circumferential areas 5*d*. The thickness of the filler 12 is substantially equal to the clearance H so as to fill the space which is provided by the clearance H in the circumferential area 5*d*. Thus, the flow resistance through the clearance between the rotor side surface 5*a* and the inner surface 3*a* of the side housing 3 can significantly be increased and leakage of combustion gas through the side seal 7 can be remarkably decreased. In addition, the filler 12 is effective to eliminate any quenching zone which would otherwise be provided by the clearance H at the circumferential area 5*d*. The arrangement is considered as providing a further advantage in case of rotary piston engines having side intake ports because the intake port timing is determined not by the side seals but by the fillers 12.

The filler or coatings 12 may be provided radially inwardly of the side seals 7 as shown by phantom lines 12*a* in FIG. 2. In such a case, the coatings 12 radially outside the side seals 7 may or may not be omitted. Where the coatings 12 are to be provided radially inside the side seals 7, the widths of the areas wherein such coatings are provided should preferably be substantially equal to the widths of the circumferential areas 5*d*.

The invention has thus been shown and described with reference to a specific embodiment, however, it should be noted that the invention is in no way limited to the details of the illustrated structures but changes and modifications may be made without departing from the scope of the appended claims.

We claim:

1. Rotary piston engine including a casing which is comprised of a rotor housing having an inner wall surface of trochoidal configuration and a pair of side housings respectively having inner surfaces and secured to the opposite sides of the rotor housing, a substantially polygonal rotor disposed in said casing for rotation with apex portions in sliding contact with the inner wall surface of the rotor housing, said rotor having opposite side surfaces respectively confronting with the inner surfaces of the side housings and provided at radially central portions thereof with axially projecting lands adapted to engage slidably with the inner surfaces of the side housings to maintain clearances between the rotor side surfaces and the inner surfaces of the side housings radially outwardly of said lands, said rotor further having flanks defined between respective two of the apex portions and confronting to the inner wall surface of the rotor housing, side seal means provided on each side surface of the rotor and extending substantially along the flanks of the rotor at portions radially inwardly of the flanks to leave circumferential areas on each of the rotor side surfaces between the flanks and the side seal means, and filler means comprised of a fluoride resin and applied to each of the rotor side surfaces at areas at least radially outwardly of said side seal means for substantially filling said clearance between the rotor side surfaces and the inner surfaces of the side housings in said areas.

2. Rotary piston engine in accordance with claim 1 in which said filler means is provided in all of said circumferential areas on each rotor side surface.

3. Rotary piston engine in accordance with claim 1 in which said fluoride resin is applied together with a thermosetting resin.

4. Rotary piston engine in accordance with claim 1 in which said filler means includes tetrafluoroethylene and 1 to 5% in weight of a solid lubricating agent.

5. Rotary piston engine in accordance with claim 1 in which filler means comprised of a fluoride resin are applied to each of the rotor side surfaces at areas radially inward and adjacent said side seal means.

* * * * *